US005709144A

United States Patent [19]

Shiokawa et al.

[11] Patent Number: 5,709,144

[45] Date of Patent: Jan. 20, 1998

[54] LEVER PRESS MACHINE HAVING A REDUCED SIZE BASED ON THE SETTING OF AN ASCENT/DESCENT STROKE OF A RAM

[76] Inventors: Hiroyasu Shiokawa, 9-3, Sone-Nishimachi 4-Chome; Shozo Shiokawa, 3-8-203, Minami Sakurazuka 1-Chome, both of Toyonaka City, Prefecture of Osaka 561, Japan

[21] Appl. No.: 685,530

[22] Filed: Jul. 24, 1996

[30] Foreign Application Priority Data

Sep. 4, 1995 [JP] Japan ..... 7-263422

[51] Int. Cl.[6] ..... B30B 1/06; B30B 15/32

[52] U.S. Cl. ..... 100/218; 83/628; 100/231; 100/282

[58] Field of Search ..... 100/231, 281, 100/282, 292, 293, 218; 83/628

[56] References Cited

U.S. PATENT DOCUMENTS

| | | | |
|---|---|---|---|
| 2,600,242 | 6/1952 | May | 100/231 |
| 3,302,505 | 2/1967 | Shiokawa | 83/628 |
| 4,195,564 | 4/1980 | Shiokawa | 100/231 |
| 4,773,325 | 9/1988 | Shiokawa et al. | 100/282 |

FOREIGN PATENT DOCUMENTS

| | | | |
|---|---|---|---|
| 1194526 | 11/1959 | France | 100/231 |
| 42-11916 | 7/1967 | Japan . | |
| 46-17752 | 5/1971 | Japan | 100/282 |

*Primary Examiner*—Stephen F. Gerrity

*Attorney, Agent, or Firm*—Wenderoth, Lind & Ponack

[57] ABSTRACT

The lever press includes various elements such as a lever (3), a fulcrum shaft (4), a crank shaft (5), a crank wheel (6), a forked portion (7), a crank pin (8), a slider (9), a large gear-wheel (10) and a motive gear-wheel (13), etc. which are dimensioned in relation to the ascent/descent stroke (S) of a ram which is set to be 1. The lever press is designed to have the same capacity as the conventional lever presses while remarkably reducing the size thereof.

3 Claims, 3 Drawing Sheets

LEVER PRESS MACHINE HAVING A REDUCED SIZE BASED ON THE SETTING OF AN ASCENT/DESCENT STROKE OF A RAM

BACKGROUND OF THE INVENTION

The present invention is related to a lever press in which a fulcrum shaft is provided close to an ascent/descent position of a ram at the upper part of the machine body, and a lower end of a lever hanging down in the machine body obliquely from the fulcrum shaft is formed into a fork shape. A slider is fitted into the forked portion and is linked with a crank so as swing. Also an amplitude of the leverhead is converted into an ascent/descent movement of the ram. The invention is characterized by making the size of the machine as small as possible while letting the machine maintain a pressing capacity equal to that of larger machines.

Particular dimensions of various elements of conventional lever presses of different capacities are as shown in Table 1.

TABLE 1

| Capacity | 220 ton | 400 ton | 630 ton |
|---|---|---|---|
| Length of the ceiling board portion | 2350 mm | 3150 mm | 3400 mm |
| Height | 4100 mm | 4730 mm | 5050 mm |
| Length of the base | 2150 mm | 3040 mm | 3420 mm |
| Width of the front | 1800 mm | 2300 mm | 2420 mm |

Currently, effective use of a factory site is very important, and the installation of large machines is not desired in the field of pressing machines. Accordingly, it has become necessary to reduce the size of the machines.

For this reason, in the field of lever presses, it has become necessary to make the machines smaller to facilitate installation of the machine without detrimentally affecting the machines.

SUMMARY OF THE INVENTION

It is the object of the present invention to reduce the size of the machine as much as possible without lowering the capacity of the lever press and to thereby facilitate installation of the machine.

For the solution of the abovementioned problems, the present invention provides a lever press in which: when an ascent/descent stroke(S) of a ram is set to be 1, the length from the vent of a leverhead to the center of a fulcrum shaft of a lever is expressed as 2; the diameter of the fulcrum shaft of the lever is expressed as 0.75; the length from the center of the fulcrum shaft to the lower end of the lever is expressed as 4.7; the lateral distance between the perpendicular at the center of the fulcrum shaft and the perpendicular at the center of the crank shaft is expressed as 0.85; the shaft-to-shaft distance between the center of the fulcrum shaft and the center of the crank shaft is expressed as 3.4; the radius of a crank is expressed as 0.85; a forked portion at a lower end of the lever has a groove of 0.8 in width and 0.4 in depth; and to the forked portion is fitted in a slide-free state, a slider in which a pin of 0.5 in diameter is fitted; a large gear-wheel of 3.4 in pitch diameter and 0.35 in thickness is connected directly to a crank wheel of 3.5 in diameter and 0.4 in thickness on the crank shaft. The large gear-wheel is made to engage with a motive gear-wheel mounted on a motive shaft provided through idle wheels with a braze wheel on its one end and with a flywheel pulley having a clutch of 3.5 in diameter on its other end. The pulley is driven by a motor installed on a ceiling board being spaced at 1 in height from the center of the fulcrum shaft of the abovementioned lever. The ceiling board is placed on a base having a width, of 3.2 a length of 2.6+3.25 and a side wall having an inside width of 1.3+0.9 and a height 6.5 to 7. A working table of 2.5 in length and 2.7 in width is disposed at a forward position of the base and positioned downward from the ascent/descent position of the ram. On the working table is disposed a knock-out of 0.85 in arm length and 0.5 in ascent/descent stroke to be driven by a knock-out shaft. The ram, to which the abovementioned leverhead is fitted in and which ascends and descends together with the leverhead at the upper part of the front of the machine body, has a width of 1.75 and a length of 1.1. All of the abovementioned numerical values have respectively a permitted limit of plus/minus 10%.

In the lever press of the present invention, by interposing two idle wheels between the large gear-wheel connected directly to the crank wheel and the motive gear-wheel in such way as the idle wheels engage with two wheels respectively and are laid before and behind in a direction of rotation, it becomes possible to double the transmitting power of rotation from the motive shaft to the crank shaft, and to cope with a large load to swing the powerful lever.

Further, the lever press of the present invention makes to good use of a space at the rear of the machine body and holds down the height of the whole machine body so as to check a rise of the center of gravity by means of linking the top of the ram with one arm of a balance lever installed on the ceiling board. The arm is two times longer than the ram stroke. Also, an end of the other arm of the balance lever is linked with a balance cylinder exposed on the ceiling board.

The particulars of various elements with respect to capacity of the lever press of the present invention, are as shown in Table 2.

TABLE 2

| Capacity | 220 ton | 400 ton | 630 ton |
|---|---|---|---|
| Length of the ceiling board portion | 2700 mm | 3300 mm | 3800 mm |
| Height | 2800 mm | 3400 mm | 4000 mm |
| Length of the base | 2100 mm | 2600 mm | 3000 mm |
| Width of the front | 1450 mm | 1750 mm | 2050 mm |

DETAILED DESCRIPTION OF THE INVENTION

A working example of the present invention will be explained with reference to the attached drawings.

Figure 1:
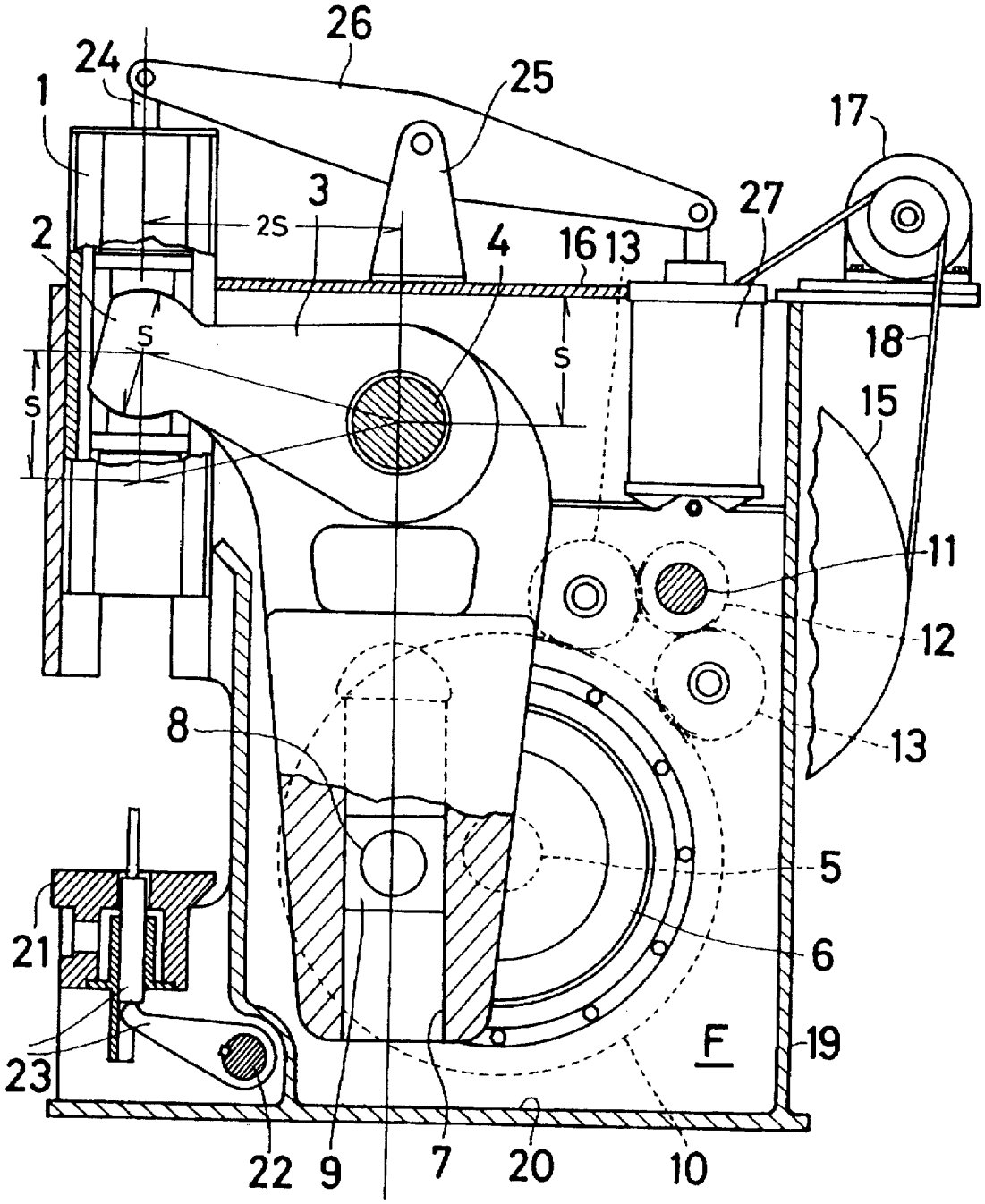
FIG. 1 is a partially cutaway vertical sectional side view illustrating an embodiment of the present invention.
Figure 2:
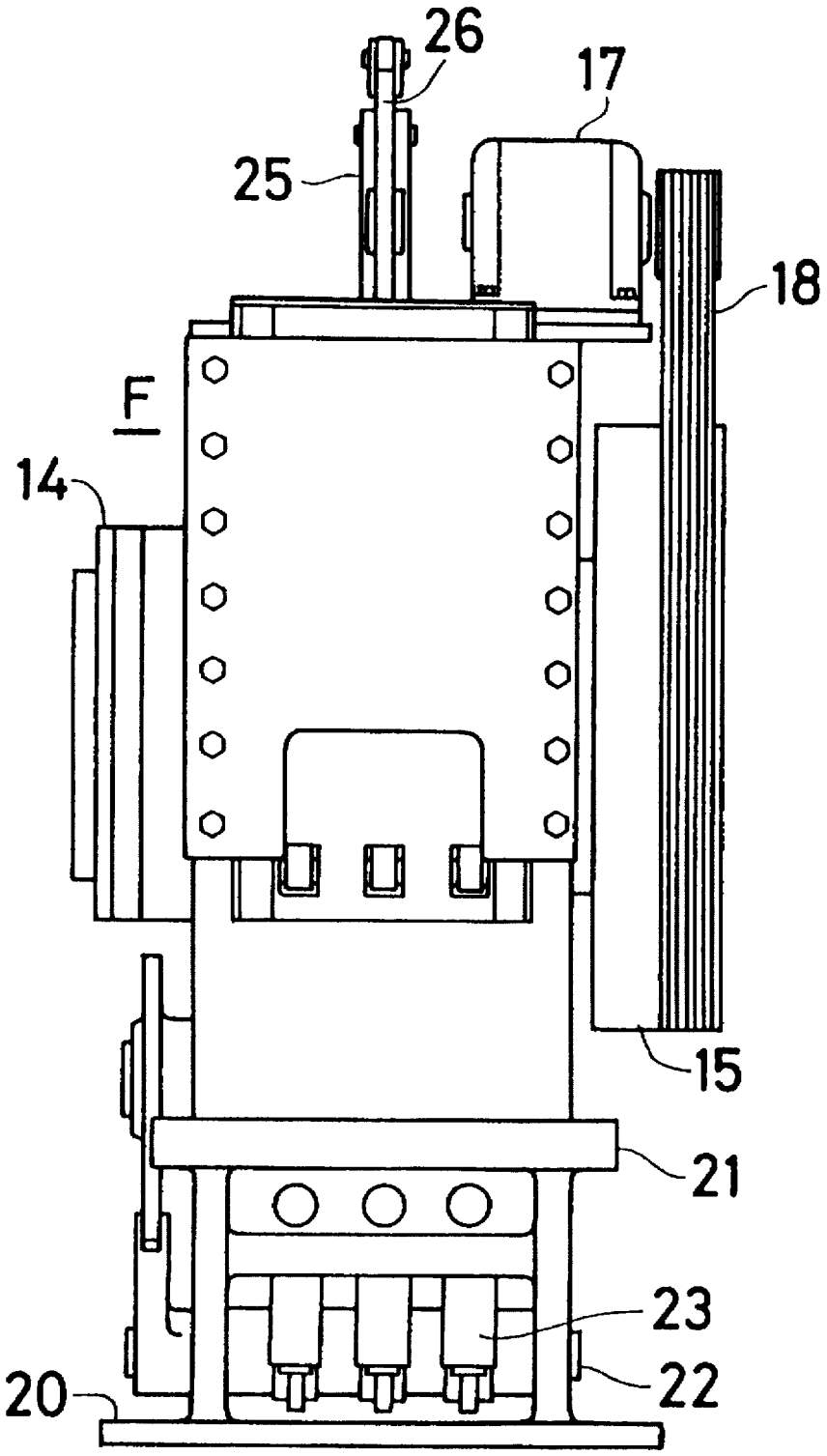
FIG. 2 is a back view of the embodiment shown in FIG. 1.
Figure 3:
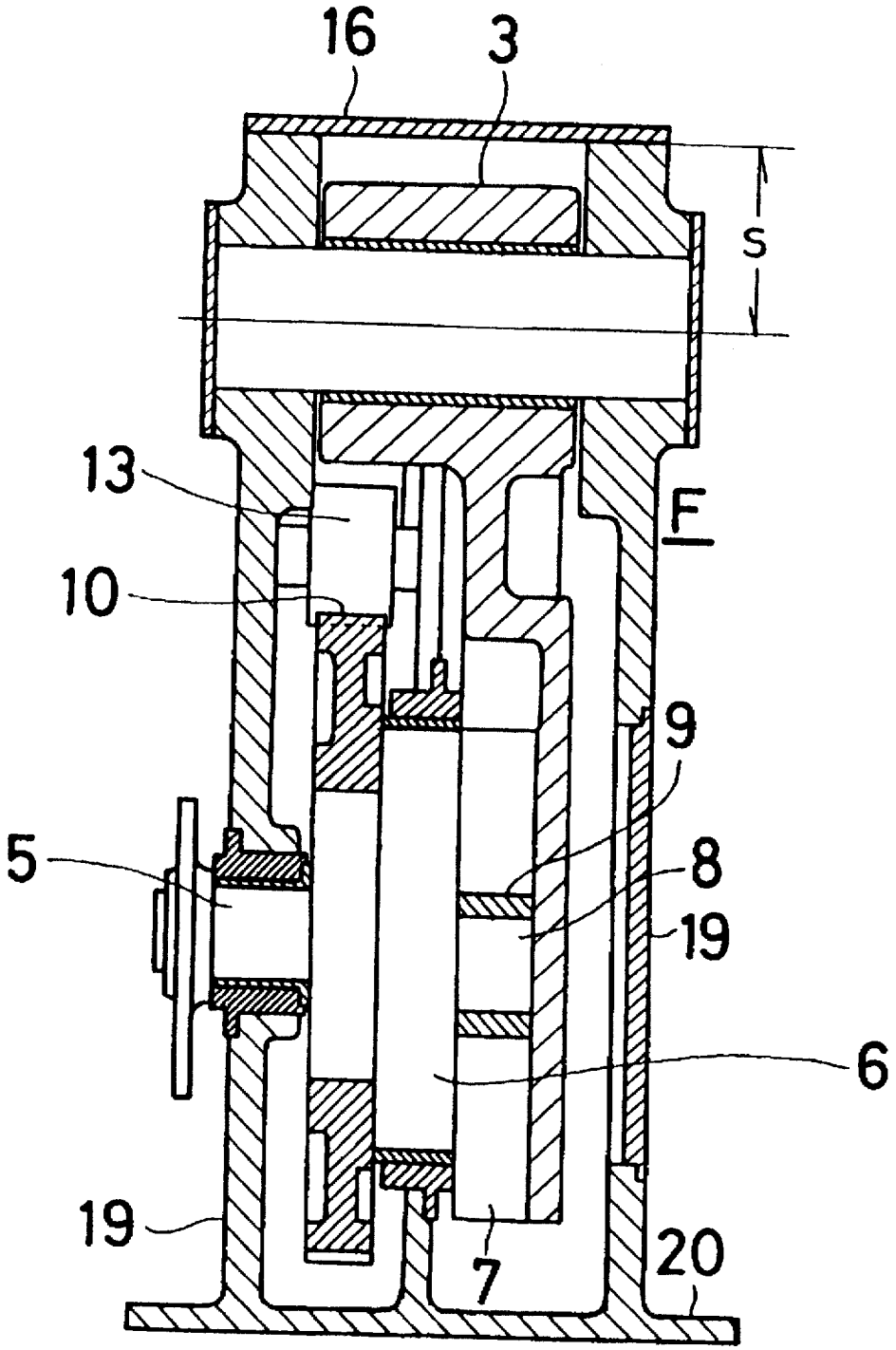
FIG. 3 is partially cutaway vertical sectional front view of the present invention.

As shown in FIG. 1, in the lever press of the present invention, when an ascent/descent stroke (S) of a ram 1 is set to be 1, the length from the center of a leverhead 2, which is fit into the ram 1, to the center of a fulcrum shaft 4 being the center of swing of a lever 3 is expressed as 2.

The diameter of the fulcrum shaft 4 is expressed as 0.75 and the length from the center of the fulcrum shaft 4 to the lower end of the lever 3 hanging down is expressed as 4.7.

A crank shaft 5, being laid sideways at the lower portion of the machine body (F) in a rotation-free state, take its position at 0.85 in a lateral direction from the center of the fulcrum shaft 4 to the rear portion of the machine body (F) and at 3.4 downward in a shaft-to-shaft distance while the effective radius of a crank wheel 6 is expressed as 0.85.

At the lower portion of the lever 3 is provided a forked portion 7 having on its inner side a groove having a width of 0.8 and a depth of 0.4, and a slider 9 fitted to the forked portion 7 in a slide-free state. Crank pin 8 of 0.5 in diameter is fitted to the slider 9. The crank wheel 6 diameter is expressed as 3.5 and its thickness as 0.45. The crank wheel 6 is connected directly to a large gear-wheel 10 of 3.4 in pitch diameter and 0.35 in thickness as one body on the crank shaft 5.

The large gear-wheel 10 is driven to rotate through two idle wheels 13, which are disposed between the large gear-wheel 10 and a motive gear-wheel 12 mounted on a motive shaft 11 laid side-ways in parallel with the crank shaft 5 at the upper part of the rear of the machine body (F). The idle wheels 13 are situated before and behind each other in a direction of rotation of the motive gear wheel. The idle wheels engage respectively with the large gear-wheel 10 and the motive gear-wheel 12.

The motive shaft 11 is provided on its one end with a brake wheel 14 and on its other end with a flywheel pulley 15 having a diameter of 3.5 and a clutch. The flywheel pulley 15 is rotatably driven by a conveyor belt 18 by a motor 17 installed on a ceiling board 16 which is located at a height of 1 being at 1 above the center of the fulcrum shaft 4 of the abovementioned lever.

The ceiling board 16 is disposed on a base 20 of 3.2 wide and 2.6+3.25 long. The base 20 has a side wall 19 of 1.3+0.9 in inner width and 6.5 to 7 in height.

A work table 21 is installed at a forward location of the base 20 and in front of the left-hand portion of FIG. 1 and below the ascent/descent position of the ram 1. The work table 21 is 2.5 long and 2.7 wide, and the work table 21 is provided with a knock-out 23 of 0.85 in arm length and 0.5 in ascent/descent stroke to be driven by a knock-out shaft 22.

The leverhead 2 is fitted into the abovementioned ram 1, which is disposed at the upper part of the front of the machine body (F). The ram has a width of 1 and a length of 1.1. A top end 24 of the ram is linked with a balance lever 26 having one arm of 2 in length and being supported in slide-free state by a bracket 25 in about the middle of the ceiling board 16.

The balance lever 26 is connected at its other end to a balance cylinder 27 disposed in an open space at the upper portion of the rear of the machine body (F) and exposed on the ceiling board 16. Through the movement of the cylinder 27, it is possible to remove a gap (shaking) between the ram 1 and the leverhead 2 and to prevent the generation of sounds and vibrations during a pressing operation.

The abovementioned numerical values of the various elements are all expressed by setting an ascent/descent stroke (S) of the ram 1 to the above, and the elements each have a permitted limit of plus/minus 10%.

The present invention has made it possible to reduce the size of the machine body without lowering the machine's pressing capacity. The reduction is obtained by means of setting the numerical value of each element as above against the ascent/descent stroke of the ram.

Table 3 and Table 4 indicate respectively the particulars of the conventional lever press and that the lever press of the present invention, both being of the same capacity.

TABLE 3

Main capacities of the conventional lever press

| | | | |
|---|---|---|---|
| Capacity | 220 ton | 400 ton | 630 ton |
| Capacity generating position | 7 mm | 7 mm | 7 mm |
| Length of stroke | 160 mm | 200 mm | 200 mm |
| Amount of slide control | 30 mm | 50 mm | 50 mm |
| Capacity of a low-type knock-out | 10 ton | 20 ton | 30 ton |
| Length of a low-type knock-out | 70 mm | 90 mm | 90 mm |

TABLE 4

Main capacities of the lever press of the present invention

| | | | |
|---|---|---|---|
| Capacity | 220 ton | 400 ton | 630 ton |
| Capacity generating position | nominal capacity generation at all positions in the length of stroke | | |
| Length of stroke | 360 mm | 440 mm | 510 mm |
| Amount of slide control | 45 mm | 55 mm | 65 mm |
| Capacity of a low-type knock-out | 22 ton | 40 ton | 63 ton |
| Length of a low type knock-out | 180 mm | 220 mm | 250 mm |

We claim:

1. A lever press comprising:

a base having a width, a length, and a sidewall, said sidewall having an inside width and a height;

a ceiling board positioned on said base;

a ram slidably positioned in an opening formed in a front portion of said ceiling board, said ram having a width and a length;

a fulcrum shaft having a central axis;

a lever mounted on said fulcrum shaft, said ever including a lever head in engagement with said ram and a lower end forming a forked portion having a groove;

a crank shaft disposed as to be parallel to said fulcrum shaft, said crank shaft having a central axis;

a crank mounted on said crank shaft and having a radius;

a slider fitted in said forked portion;

a pin fitted in said slider, said pin having a diameter;

a large gear wheel, connected to said crank wheel, having a pitch diameter and a thickness;

a plurality of idle wheels mounted so as to engage a periphery of said large gear wheel;

a motive gear wheel mounted on a motive shaft, wherein said large gear wheel contacts said motive gear wheel through said idle wheels;

a brake wheel provided on a first end of said motive shaft;

a flywheel pulley provided on a second end of said motive shaft, said flywheel pulley having a clutch and a flywheel pulley diameter;

a motor, mounted on said ceiling board, for driving said flywheel pulley;

a working table disposed below said ram at a forward location of said base, said working table having a length and a width; and a knock-out disposed in said working table and being drivingly coupled with a knock-out shaft, said knock-out having an arm which has a length and is coupled to a knock-out drive shaft, wherein when a stroke(S) of said ram is set at 1 S:

the distance from the center of said leverhead to the central axis of said fulcrum shaft is 2 S;

the diameter of said fulcrum shaft is 0.75 S;

the distance from said fulcrum shaft central axis to said lower end of said lever is 4.7 S;

a lateral distance between a vertical line passing through the center of said fulcrum shaft and a vertical line passing through the center of said crank shaft is 0.85 S;

the distance between the central axis of said fulcrum shaft and the central axis of said crank shaft is 3.4 S;

the radius of said crank is 0.85 S;

the width of said groove is 0.8 S and the depth of said groove is 0.4 S;

the diameter of said pin is 0.5 S;

the pitch diameter of large gear wheel is 3.4 S and the thickness of said large gear wheel is 0.35 S;

the diameter of said crank wheel is 3.5 S and the thickness of said crank wheel is 0.4 S;

the diameter of said flywheel pulley is 3.5 S;

the ceiling board is located a distance of 1 S above the central axis of said fulcrum shaft;

the width of said base is 3.2 S and the length of said base is 2.6 S+3.25 S;

the inside width of said sidewall is 1.3 S+0.9 S and the height of said sidewall is 6.5 S to 7 S;

the length of said working table is 2.5 S and the width of said working table is 2.7 S;

the length of said knock-out arm is 0.85 S and said knock-out arm has a stroke length of 0.5 S; and the width of said ram is 1.75 S and the length of said ram is 1.1 S.

2. The lever press as claimed in claim 1, wherein said idle wheels comprise first and second gear-wheels, each of said first and second gear wheels engage said motive gear-wheel and said large gear-wheel, and said first and second gear wheels are positioned before and behind said motive shaft with respect to a direction of rotation of said motive shaft respectively.

3. The lever press as claimed in claim 1, further comprising:

a balance lever disposed on said ceiling board and having a first arm connected to a top end of said ram and a second arm; and a balance cylinder positioned in an opening formed in said ceiling board, said balance cylinder being connected to said second arm of said balance lever, wherein said first arm has a length of 2 S.

* * * * *